US008845311B2

(12) United States Patent
Fujiwara et al.

(10) Patent No.: US 8,845,311 B2
(45) Date of Patent: Sep. 30, 2014

(54) SCREW COMPRESSOR WITH ADJACENT HELICAL GROOVES SELECTIVELY OPENING TO FIRST AND SECOND PORTS

(75) Inventors: Hideki Fujiwara, Sakai (JP); Hideyuki Gotou, Kent (GB); Harunori Miyamura, Kent (GB); Nozomi Gotou, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 457 days.

(21) Appl. No.: 12/810,951

(22) PCT Filed: Dec. 26, 2008

(86) PCT No.: PCT/JP2008/004026

§ 371 (c)(1),
(2), (4) Date: Jun. 28, 2010

(87) PCT Pub. No.: WO2009/084233

PCT Pub. Date: Jul. 9, 2009

(65) Prior Publication Data

US 2010/0284848 A1 Nov. 11, 2010

(30) Foreign Application Priority Data

Dec. 28, 2007 (JP) ..... 2007-340274

(51) Int. Cl.

| | |
|---|---|
| ***F01C 1/08*** | (2006.01) |
| ***F04C 18/52*** | (2006.01) |
| ***F01C 17/02*** | (2006.01) |
| ***F04C 23/00*** | (2006.01) |
| ***F04C 29/12*** | (2006.01) |
| ***F04C 29/00*** | (2006.01) |
| *F04C 18/16* | (2006.01) |
| *F04C 27/00* | (2006.01) |

(52) U.S. Cl.

CPC ..... *F04C 18/52* (2013.01); *F04C 18/16* (2013.01); *F04C 2240/30* (2013.01); *F04C 2270/17* (2013.01); *F04C 27/007* (2013.01); *F04C 2270/16* (2013.01); *F04C 23/001* (2013.01); *F04C 29/124* (2013.01); *F04C 2240/52* (2013.01); *F04C 2240/603* (2013.01); *F04C 29/0078* (2013.01); *F04C 2270/58* (2013.01); *F01C 17/02* (2013.01); *F04C 27/004* (2013.01)

USPC ..... 418/195; 418/201.1

(58) Field of Classification Search

USPC ..... 418/195, 201.1, 201.2, 206.1, 206.4

See application file for complete search history.

(56) References Cited

U.S. PATENT DOCUMENTS 3,088,658 A * 5/1963 Wagenius ..... 418/201.2
3,088,659 A * 5/1963 Nilsson et al. ..... 418/159

(Continued)

FOREIGN PATENT DOCUMENTS

JP 09-291891 A 11/1997
JP 2005-54719 A 3/2005
JP 2005-90293 A 4/2005

*Primary Examiner* — Mary A Davis
*Assistant Examiner* — Paul Thiede
(74) *Attorney, Agent, or Firm* — Global IP Counselors

(57) ABSTRACT

A screw compressor includes a screw rotor having a plurality of helical grooves, a casing containing the screw rotor and a gate rotor. The casing includes a discharge port on an inner peripheral surface of the casing. The gate rotor has gates meshing with the helical grooves of the screw rotor to compress gas in compression chambers to discharge the gas from the discharge port after being compressed. The compression chambers are defined by the helical grooves, the casing, and the gates. The discharge port is divided into a first port and a second port when two adjacent helical grooves of the plurality of helical grooves is open to the discharge port as a result of rotation of the screw rotor, with one of the two adjacent helical grooves being open in the first port and the other of the two adjacent helical grooves being open in the second port.

2 Claims, 12 Drawing Sheets

(56) References Cited

U.S. PATENT DOCUMENTS

| | | | | | |
|---|---|---|---|---|---|
| RE29,283 | E | * | 6/1977 | Shaw | 417/282 |
| 4,074,957 | A | * | 2/1978 | Clarke et al. | 418/195 |
| 4,261,691 | A | * | 4/1981 | Zimmern et al. | 418/195 |
| 4,388,040 | A | * | 6/1983 | Sakamaki | 415/174.2 |
| 4,388,048 | A | * | 6/1983 | Shaw et al. | 417/310 |
| RE31,379 | E | * | 9/1983 | Shaw | 417/310 |
| 4,548,549 | A | * | 10/1985 | Murphy et al. | 417/53 |
| 4,609,329 | A | * | 9/1986 | Pillis et al. | 417/282 |
| 4,610,612 | A | * | 9/1986 | Kocher | 418/195 |
| 4,610,613 | A | * | 9/1986 | Szymaszek | 418/195 |
| 7,153,112 | B2 | * | 12/2006 | Zarnoch et al. | 418/195 |
| 2005/0123429 | A1 | | 6/2005 | Zarnoch et al. | |

* cited by examiner

SCREW COMPRESSOR WITH ADJACENT HELICAL GROOVES SELECTIVELY OPENING TO FIRST AND SECOND PORTS

CROSS-REFERENCE TO RELATED APPLICATIONS

This U.S. National stage application claims priority under 35 U.S.C. §119(a) to Japanese Patent Application No. 2007-340274, filed in Japan on Dec. 28, 2007, the entire contents of which are hereby incorporated herein by reference.

TECHNICAL FIELD

The present invention relates to a screw compressor.

BACKGROUND ART

In the past, a single screw compressor has been known which includes one screw rotor, a casing for containing the screw rotor, and two gate rotors as a compressor for compressing gas such as a refrigerant and air (see Japanese Patent Publication No. 2005-90293).

In this screw compressor, a compression chamber is formed by closed space partitioned by a helical groove of the screw rotor, the casing, and gates of the gate rotors. The screw compressor rotates the screw rotor, thereby moving the gates in the helical grooves of the screw rotor relatively to compress gas in the compression chamber. Furthermore, the casing is provided with a discharge port at a position corresponding to proximity of a terminating end of the helical groove of the screw rotor, and the helical groove is open in the discharge port as a result of the rotation of the screw rotor to thereby discharge compressed high-pressure gas from the discharge port.

SUMMARY

Technical Problem

Depending on, for example, a size of the discharge port, a width of the helical groove, and an interval of the adjacent helical grooves, two adjacent helical grooves may be simultaneously open in the discharge port. In other words, right before a helical groove having been more early open in the discharge port is uncoupled from the discharge port (not open in the discharge port), the next helical groove may be open in the discharge port.

At this time, the former helical groove substantially completes the discharge, and has a lower inner pressure in comparison with that right after the discharge. In contrast, the latter helical groove stays right after a start of the discharge, and has a high inner pressure. Thereby, pressure in the latter helical groove right after the discharge may propagate to the former helical groove, and increase discharging work to decrease efficiency of the compressor.

The present invention was made in light of such matters, and it is an object thereof to prevent a decrease in efficiency of the compressor caused by allowing two adjacent helical grooves to be simultaneously open in the discharge port.

Solution to the Problem

A first aspect of the present invention relates to a screw compressor including a screw rotor (40) having a plurality of helical grooves (41, 41, . . . ) formed, a casing (10) for containing the screw rotor (40) and provided with a discharge port on an inner peripheral surface thereof, and a gate rotor (50) having gates (51, 51, . . . ) meshing with the helical grooves (41, 41, . . . ) of the screw rotor (40), and compressing gas in compression chambers (23, 23, . . . ) formed by the helical grooves (41, 41, . . . ), the casing (10), and the gates (51, 51, . . . ) to discharge the gas from the discharge ports (73, 73). Furthermore, the discharge port (73) is divided into a first port (74*b*) and a second port (75*b*), in a state of the two adjacent helical grooves (41, 41) among the helical grooves (41, 41, . . . ) being open in the discharge port as a result of the screw rotor (40), one of the two adjacent helical grooves (41, 41) being open in the first port (74*b*), the other being open in the second port (75*b*).

In the case of the above configuration, even when two adjacent helical grooves (41, 41) are simultaneously open in the discharge port (73), discharge pressure is inhibited from propagating from a helical groove (41) right after open in the discharge port (73) to a helical groove (41) right before uncoupled from the discharge port (73) since the discharge port (73) is divided into the first port (74*b*) and the second port (75*b*). As a result, discharging work of the screw compressor can be inhibited from increasing, which can improve efficiency of the compressor.

Meanwhile, when only one helical groove (41) is open in the discharge port (73), this helical groove (41) can be open in both the first and second ports (74*b*, 75*b*) or in only either one of the first and second ports (74*b*, 75*b*).

In accordance with a second aspect of the present invention, an opening (16) formed in the casing (10), and further includes a slide valve (7) arranged in the opening (16) of the casing (10), the slide valve (7) being provided with the first and second ports (74*b*, 75*b*), and a partition wall (76) dividing the first port (74*b*) from the second port (75*b*) in the first invention.

In the case of the above configuration, by moving the slide valve (7), a position of the discharge port (73) is changed, and timing is also changed which two adjacent helical grooves (41, 41) are open in the discharge port (73) simultaneously at. Accordingly, by providing the partition wall (76) dividing the discharge port (73) into the first port (74*b*) and the second port (75*b*) in the slide valve (7) configuring the discharge port (73), even when timing is changed which two adjacent helical grooves (41, 41) are open in the discharge port (73) simultaneously at, a position of the partition wall (76) can be changed according to the change of timing, which can surely inhibit discharge pressure from propagating from a helical groove (41) right after open in the discharge port (73) to a helical groove (41) right before uncoupled from the discharge port (73).

In accordance with a third aspect of the present invention, in the casing (10), the discharge passages (17, 17) communicating with the discharge ports (73, 73) are formed at a downstream side of the discharge ports (73, 73), the discharge passage (17) being divided into a first discharge passage (17*a*) communicating with the first port (74*b*) and a second discharge passage (17*b*) communicating with the second port (75*b*) in the first or second invention.

In the case of the above configuration, by dividing the first and second discharge passages (17*a*, 17*b*) communicating with the first and second ports (74*b*, 75*b*), respectively, at a downstream side of the first and second ports (74*b*, 75*b*), even after flowing out of the first and second ports (74*b*, 75*b*) to the first and second discharge passages (17*a*, 17*b*), respectively, gas does not immediately join with each other. Thereby, discharge pressure can be further surely inhibited from propagating from a helical groove (41) right after open in the discharge port (73) to a helical groove (41) right before uncoupled from the discharge port (73).

Advantages of the Invention

In accordance with the first aspect of the present invention, the discharge port (73) is divided into the first port (74*b*) and the second port (75*b*), one of the two adjacent helical grooves (41, 41) being open in the first port (74*b*) when the two adjacent helical grooves (41, 41) are open in the discharge port (73), the other being open in the second port (75*b*). Thereby, discharge pressure is inhibited from propagating from a helical groove (41) right after open in the discharge port (73) to a helical groove (41) immediately before the discharge port (73) closes, which can therefore decrease discharging work and improve efficiency of the compressor.

In accordance with the second aspect of the present invention, the first and second ports (74*b*, 75*b*) and the partition wall (76) dividing the discharge port (73) into the first ports (74*b*) and the second port (75*b*) are provided in the slide valve (7). Thereby, even when by changing a position of the slide valve (7), timing is changed which two adjacent helical grooves (41, 41) are simultaneously open in the discharge port (73) at, discharge pressure can be inhibited from propagating from a helical groove (41) right after open in the discharge port (73) to a helical groove (41) right before uncoupled from the discharge port (73).

In accordance with the third aspect of the present invention, the discharge passage (17) communicating with the discharge port (73) is divided into the first discharge passage (17*a*) communicating with the first port (74*b*) and the second discharge passage (17*b*) communicating with the second port (75*b*). Thereby, discharge pressure can be surely inhibited from propagating from a helical groove (41) right after open in the discharge port (73) to a helical groove (41) right before uncoupled from the discharge port (73).

DESCRIPTION OF EMBODIMENTS

Embodiments of the present invention will be described below in detail on the basis of the drawings.

An Embodiment 1 of the Present Invention

Figure 2:
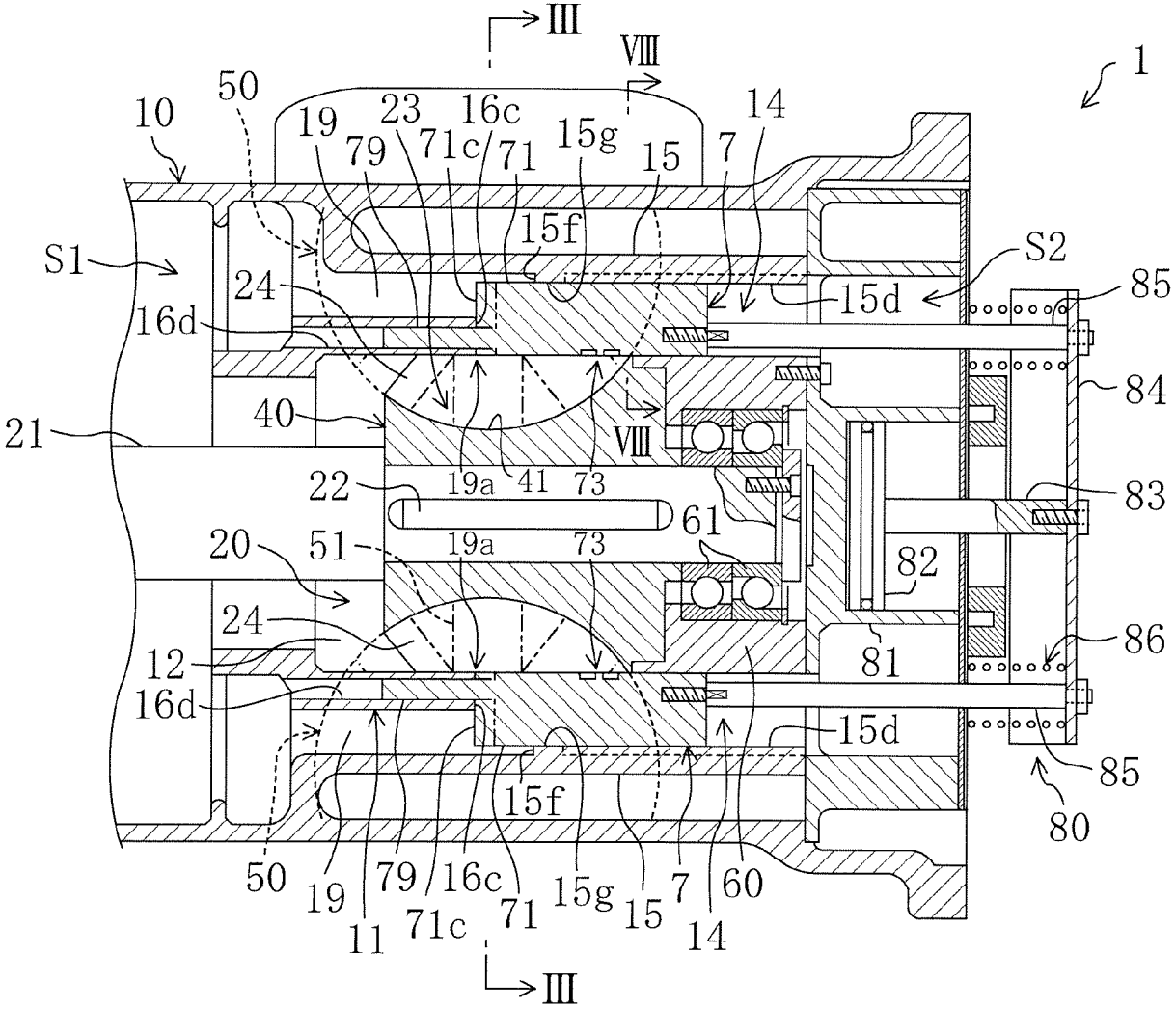
FIG. 2 is a longitudinal cross-sectional view showing a configuration of a main section of a single screw compressor.
Figure 3:
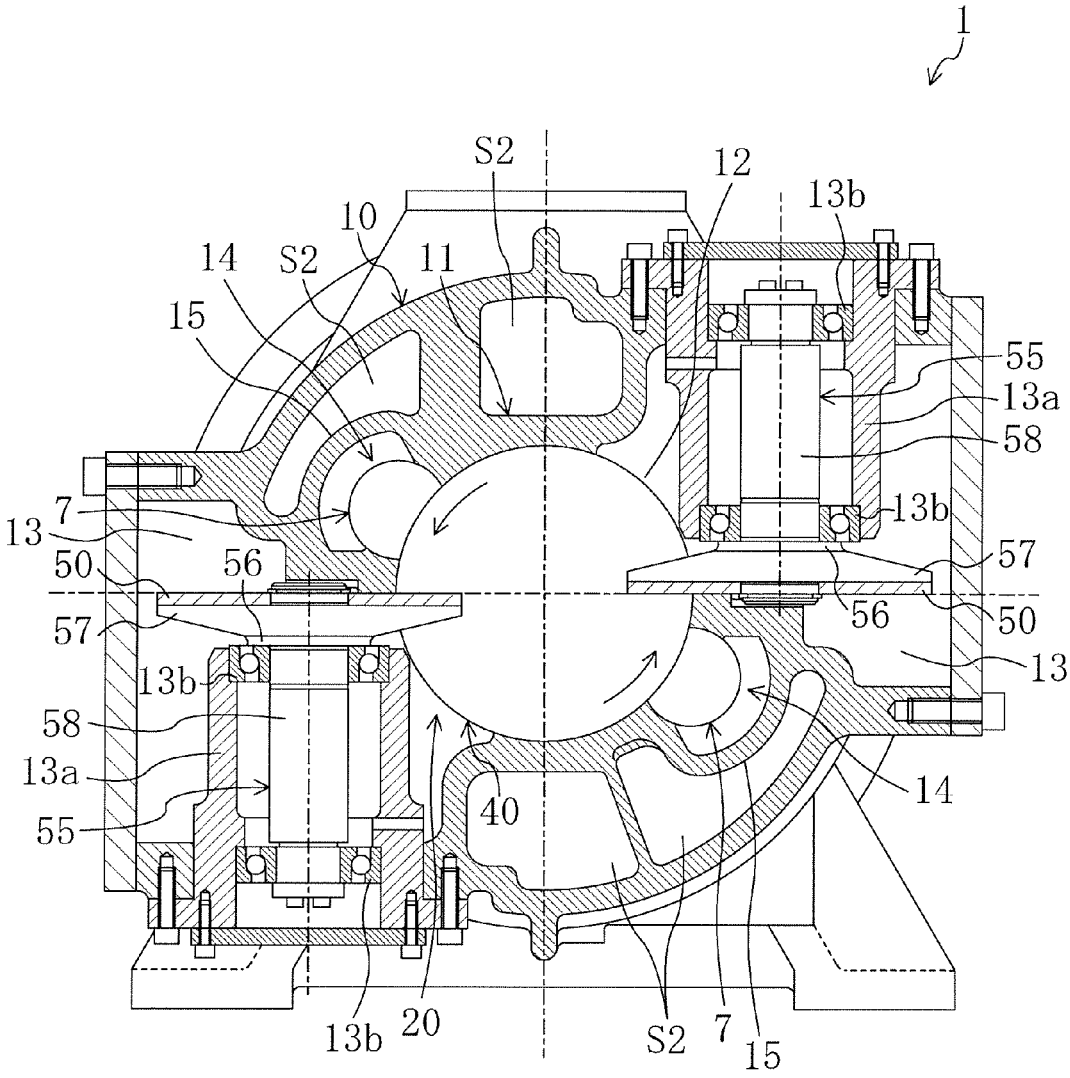
FIG. 3 is a lateral cross-sectional view taken from line in FIG. 2.

A screw compressor (1) in accordance with an embodiment 1 of the present invention is provided in a refrigerant circuit performing a refrigeration cycle, and is designed to compress a refrigerant. The screw compressor (1) is configured to be semi-closed as shown in FIGS. 2 and 3. In this screw compressor (1), a compression mechanism (20) and an electric motor (not shown in any drawing) driving the compression mechanism (20) are contained in one casing (10). The compression mechanism (20) is coupled with the electric motor through a driving shaft (21). Additionally, in the casing (10), a low-pressure space (S1) to which a low-pressure gas refrigerant is introduced from an evaporator of the refrigerant circuit and which guides the low-pressure gas to the compression mechanism (20), and high-pressure space (S2) into which a high-pressure gas refrigerant discharged from the compression mechanism (20) flows, are partitionally formed.

The compression mechanism (20) includes one screw rotor (40), a cylindrical wall (11) configuring a part of the casing (10) and partitionally forming a screw rotor containing-chamber (12) containing the screw rotor (40), and two gate rotors (50) meshing with the screw rotor (40).

The driving shaft (21) is inserted into the screw rotor (40). The screw rotor (40) and the driving shaft (21) are coupled by a key (22). The driving shaft (21) is located coaxially with the screw rotor (40). A tip of the driving shaft (21) is rotatably supported in a bearing holder (60) residing at the high-pressure space (S2) side (a right side in a right-left direction of an axis of the driving shaft (21) in FIG. 2) of the compression mechanism (20). The bearing holder (60) supports the driving shaft (21) through a ball bearing (61).

Figure 4:
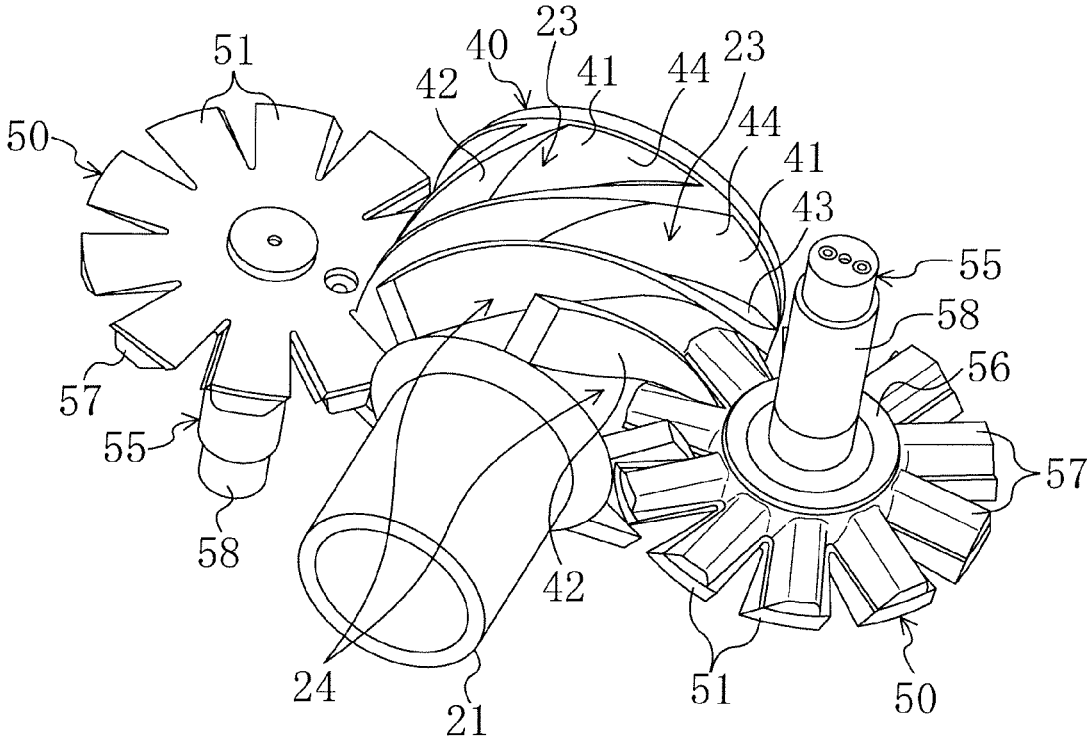
FIG. 4 is a perspective view showing a screw rotor and a gate rotor.
Figure 5:
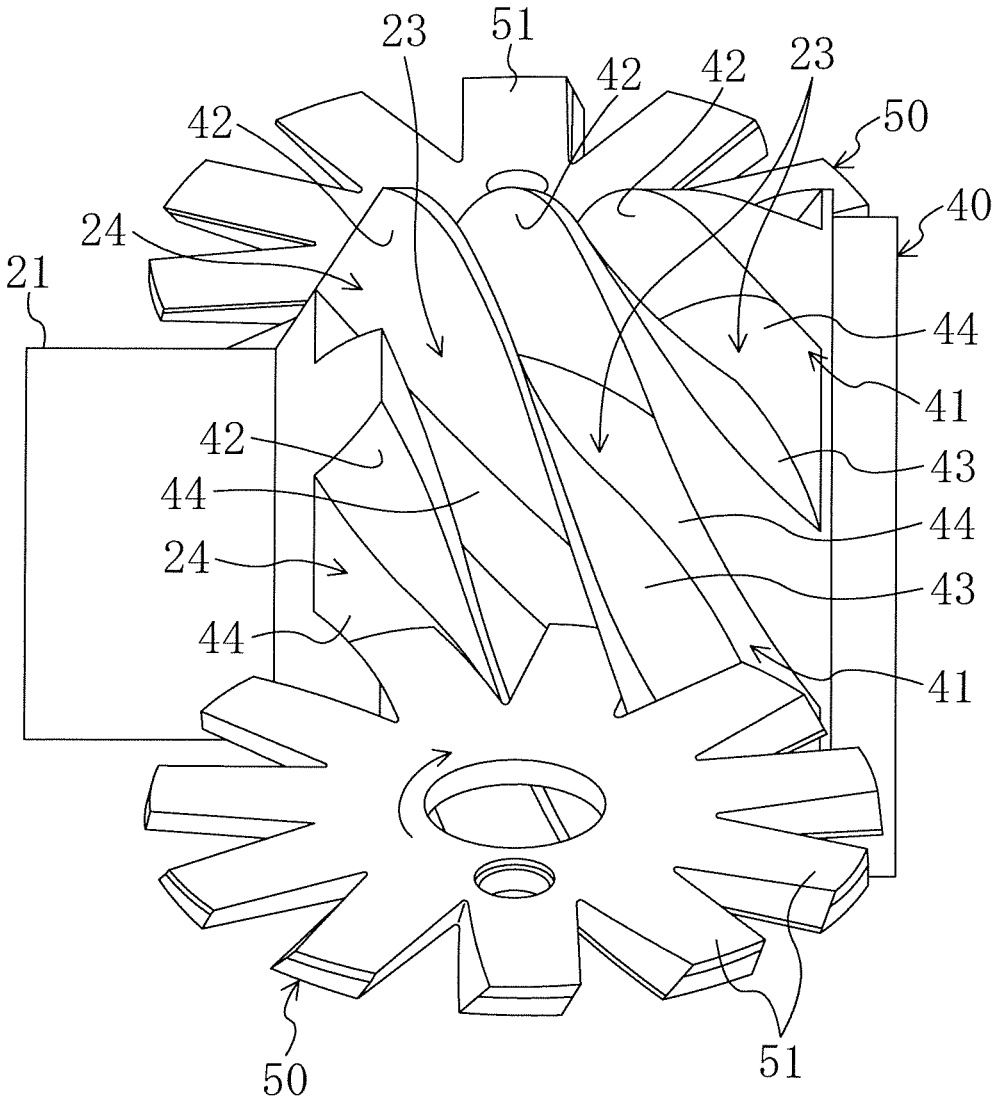
FIG. 5 is a perspective view by viewing a screw rotor and a gate rotor from another angle.

As shown in FIGS. 4 and 5, the screw rotor (40) is a metal member formed to be almost columnar. The screw rotor (40) is rotatably fitted to the cylindrical wall (11), and has its outer peripheral surface in slidable contact with an inner peripheral surface of the cylindrical wall (11). In an outer peripheral portion of the screw rotor (40), a plurality of helical grooves (41, 41, . . . ) are formed which helically extend from one end of the screw rotor (40) toward the other end.

Each helical groove (41) of the screw rotor (40) has a start end at one end side (a left side in FIG. 5) and a terminating end at the other end side (a right side in FIG. 5) in an axial direction of the screw rotor (40). The screw rotor (40) also has its peripheral edge portion in one end surface in the axial direction formed into a taper surface. Additionally, the start end of the helical groove (41) is open in the taper surface while the terminating end of the helical groove (41) is open in the outer peripheral surface of the screw rotor (40), and not open in the other end surface in the axial direction.

The helical groove (41) is configured by a first side wall surface (42) residing at a front side of an advancing direction of a gate (51) described below of the gate rotor (50), a second side wall surface (43) residing at a back side of the advancing direction of the gate (51), and a bottom wall surface (44).

Each gate rotor (50) is a resinous member radially provided with the plurality of gates (51) formed into rectangular plates. Each gate rotor (50) is contained in a gate rotor containing-chamber (13) located outside the cylindrical wall (11) axisymmetrically about the rotation axis of the screw rotor (40) (see FIG. 3). The gate rotor containing-chamber (13) communicates with the screw rotor containing-chamber (12) through a slit (not shown in any drawing) formed in the cylindrical wall (11) while each gate rotor (50) is located so as to enable the gates (51, 51, . . . ) to mesh with the helical grooves (41, 41, . . . ) of the screw rotor (40) by penetrating the slit of the cylindrical wall (11).

The gate rotor (50) is attached to a metal rotor supporting member (55) (see FIG. 4). The rotor supporting member (55) includes a basal portion (56), an arm portion (57), and a shaft portion (58). The basal portion (56) is formed into a slightly thick circular plate. The same number of the arm portions (57) as that of the gates (51) of the gate rotor (50) are provided, and radially extend from the outer peripheral surface of the basal portion (56) toward the outer side. The shaft portion (58) is formed into a stick to be erected on the basal portion (56). A central axis of the shaft portion (58) conforms to a central axis of the basal portion (56). The gate rotors (50) is attached to a side opposite to the shaft portion (58) with respect to the basal portion (56) and the arm portion (57). Each portion (57) abuts on a reverse surface (also referred to as a back surface) of the gate (51).

Two gate rotors (50, 50) is arranged in the gate rotor containing-chamber (13) so that its shaft center is orthogonal to a plane including a shaft center of the screw rotor (40). At this time, each gate rotor (50) is arranged so as to enable its front surface to face a direction opposed to a rotation direction of the screw rotor (40) in a state of meshing with the helical groove (41) of the screw rotor (40). In other words, each gate rotor (50) is arranged so as to enable the shaft portion (58) to extend in a tangential direction of the rotation direction of the screw rotor (40). As a result, two shaft portions (58, 58) extend in directions opposite to each other across the plane including the shaft center of the screw rotor (40). In other words, in FIG. 3, the gate rotor (50) located at the left side is placed in a attitude in which the rotor supporting member (55) faces downward while the gate rotor (50) located at the right side is placed in a attitude in which the rotor supporting member (55) faces upward. The shaft portion (58) of each rotor supporting member (55) is rotatably supported in a bearing housing (13*a*) in the gate rotor containing-chamber (13) through ball bearings (13*b*, 13*b*).

In the compression mechanism (20), a compression chamber (23) is a closed space surrounded by the inner peripheral surface of the cylindrical wall (11), the helical groove (41) of the screw rotor (40), and the gate (51) of the gate rotors (50). The helical groove (41) of the screw rotor (40) has its start end portion opened to the low-pressure space (S1), and this opened portion works as a suction port (24) of the compression mechanism (20).

The screw compressor (1) is provided with two slide valves (7) as a capacity control mechanism. These slide valves (7) configure a discharge port (73) and a bypass port (19*a*).

Figure 6:
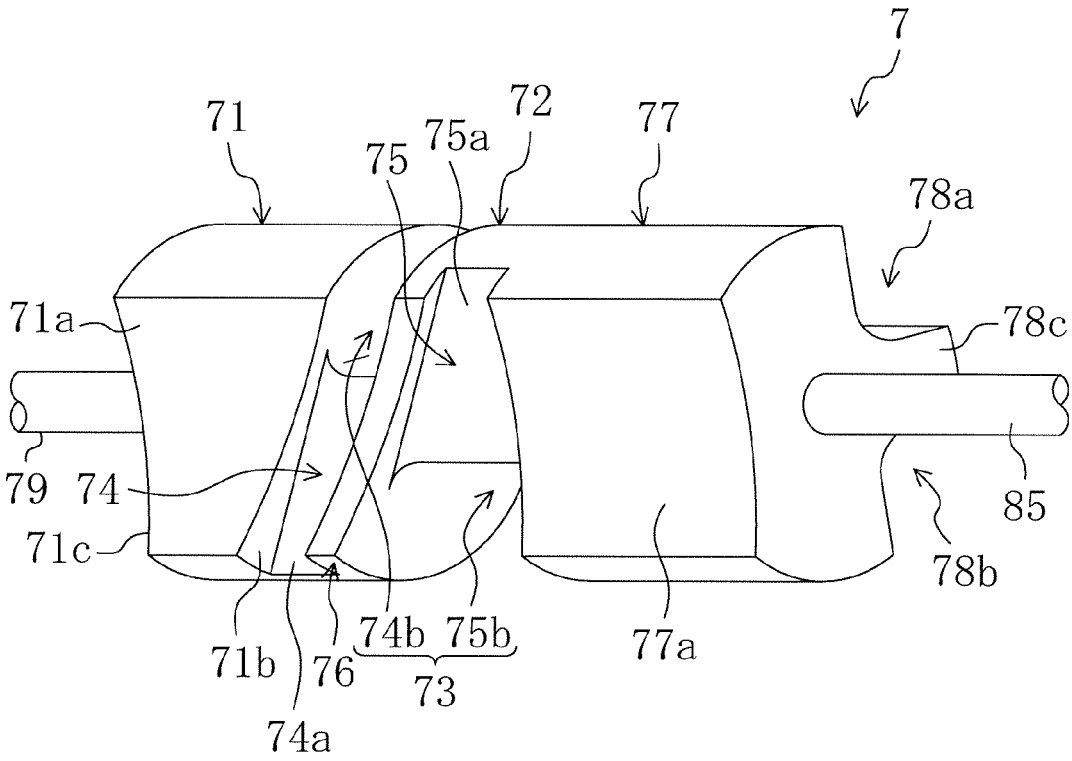
FIG. 6 is a perspective view of a slide valve.

As shown in FIG. 6, the slide valve (7) has a basic shape that is a column to have a shape formed by cutting a part of the column, and has a valve body (71) provided at one side in an axial direction, a guide portion (77) provided at the other side in the axial direction, a port portion (72) provided between the valve body (71) and the guide portion (77).

The valve body (71) has a recessed curve surface (71*a*) formed by cutting a part of an outer peripheral surface of the column in the axial direction, an inclined surface (71*b*) as a boundary surface with the port portion (72) inclined with respect to the axial direction, and a distal end surface (71*c*) as a surface opposite to the inclined surface (71*b*) in the axial direction formed into a plane orthogonal to the axial direction.

The recessed curve surface (71*a*) is recessed inward in a radial direction, and has a curvature substantially equal to a curvature of the inner peripheral surface of the cylindrical wall (11), in other words, a curvature substantially equal to a curvature of the outer peripheral surface of the screw rotor (40).

The inclined surface (71*b*) is inclined at an angle substantially equal to an inclination angle (with respect to the axis of the screw rotor (40)) of the terminating end portion of the helical groove (41) of the screw rotor (40) in a state in which the slide valve (7) is contained in a slide valve containing-chamber (14) described below (see FIG. 1(A)).

The valve body (71) configured in this way is trapezoidal in cross-section cut by a plane parallel to the recessed curve surface (71*a*). The valve body (71) also has a cross-sectional shape orthogonal to the axis formed by cutting a part of a circle by a part of an outer periphery of another circle.

Similarly to the valve body (71), the guide portion (77) has a recessed curve surface (77*a*) formed by cutting a part of an outer peripheral surface of the column in the axial direction. This recessed curve surface (77*a*) is recessed inward in a radial direction, and has a curvature substantially equal to a curvature of the inner peripheral surface of the cylindrical wall (11), in other words, a curvature substantially equal to a curvature of the outer peripheral surface of the screw rotor (40).

The guide portion (77) also has two first and second cutout portions (78*a*, 78*b*) formed at an opposite side (hereinafter also referred to as a rear surface side) to the recessed curve surface (77*a*) across the axis. Each of the first and second cutout portions (78*a*, 78*b*) extends in the axial direction, and is formed by cutting to have a cross-section of a substantial L-shape. Additionally, in the guide portion (77), a rear surface partition wall (78*c*) is formed which is sandwiched by these two first and second cutout portions (78*a*, 78*b*) to project to the rear surface side. This first cutout portion (78*a*), this second cutout portion (78*b*), and this rear surface partition wall (78*c*) are also formed at the port portion (72) continuously, and an end portion at the valve body (71) side extends up to the inclined surface (71*b*). In this way, the guide portion (77) has a substantially T-shaped cross-section orthogonal to the axis. Additionally, in the guide portion (77), a part between the recessed curve surface (77*a*) and the first cutout portion (78*a*), a part between the recessed curve surface (77*a*) and the second cutout portion (78*b*), and a projecting end surface of the rear surface partition wall (78*c*) are formed into an outer peripheral surface of a column.

The port portion (72) has the discharge port (73) formed. Circumstantially, the port portion (72) is adjacent to the recessed curve surface (71*a*) of the valve body (71) in the axial direction, and has two first and second recessed portions (74, 75) depressed more than the recessed curve surface (71*a*) inward in the radial direction. Specifically, in the port portion (72), the first recessed portion (74), a partition wall (76), and the second recessed portion (75) are formed by being aligned from the valve body (71) side toward the other end side in the axial direction in the order.

The partition wall (76) is formed so as to be substantially parallel to the inclined surface (71*b*) of the valve body (71), and isolates the first recessed portion (74) from the second recessed portion (75) in the axial direction. A distal end surface of the partition wall (76) is recessed inward in a radial direction, and has a curvature substantially equal to a curvature of the inner peripheral surface of the cylindrical wall (11), in other words, a curvature substantially equal to a curvature of the outer peripheral surface of the screw rotor (40). Therefore, the distal end surface of the partition wall (76), the recessed curve surface (71*a*) of the valve body (71), and the recessed curve surface (77*a*) of the guide portion (77) form an inner peripheral surface of the same circular cylinder.

The first recessed portion (74) is formed by being sandwiched by the inclined surface (71*b*) of the valve body (71) and the partition wall (76). The first recessed portion (74) has a depressed surface (74*a*) as a bottom surface. In this depressed surface (74*a*), a first port (74*b*) is formed toward the rear surface side. This first port (74*b*) is formed into a groove by cutting a columnar part between the first recessed portion (74) and the first cutout portion (78*a*) in a radial direction, and enables the first recessed portion (74) to communicate with the first cutout portion (78*a*).

On the other hand, the second recessed portion (75) is formed by being isolated from the first recessed portion (74) in the axial direction by the partition wall (76). The second recessed portion (75) has a depressed surface (75*a*) as a bottom surface. In this depressed surface (75*a*), a second port (75*b*) is formed by penetrating toward the rear surface side. This second port (75*b*) is formed into a groove by cutting a columnar part between the second recessed portion (75) and the second cutout portion (78*b*) in the radial direction, and enables the second recessed portion (75) to communicate with the second cutout portion (78*b*).

The port portion (72) also has a substantially T-shaped cross-section orthogonal to the axis similarly to the guide portion (77). Additionally, in the port portion (72), a part between the second recessed portion (75) and the first cutout portion (78*a*), a part between the first recessed portion (74) and the second cutout portion (78*b*), and a projecting end surface of the rear surface partition wall (78*c*) are formed into an outer peripheral surface of a column.

Additionally, the slide valve (7) has a guide rod (79) extending from the valve body (71) in the axial direction and a coupling rod (85) extending from the guide portion (77) in the axial direction.

The slide valve (7) configured in this way is contained in the slide valve containing-chamber (14) formed in the cylindrical wall (11) of the casing (10) slidably in the axial direction. As shown in FIGS. 2 and 3, the slide valve containing-chambers (14) are formed at symmetrical positions about the shaft center of the screw rotor (40) in the cylinder wall (11), the positions corresponding to the terminating end portion of the helical groove (41) of the screw rotor (40).

Figure 7:
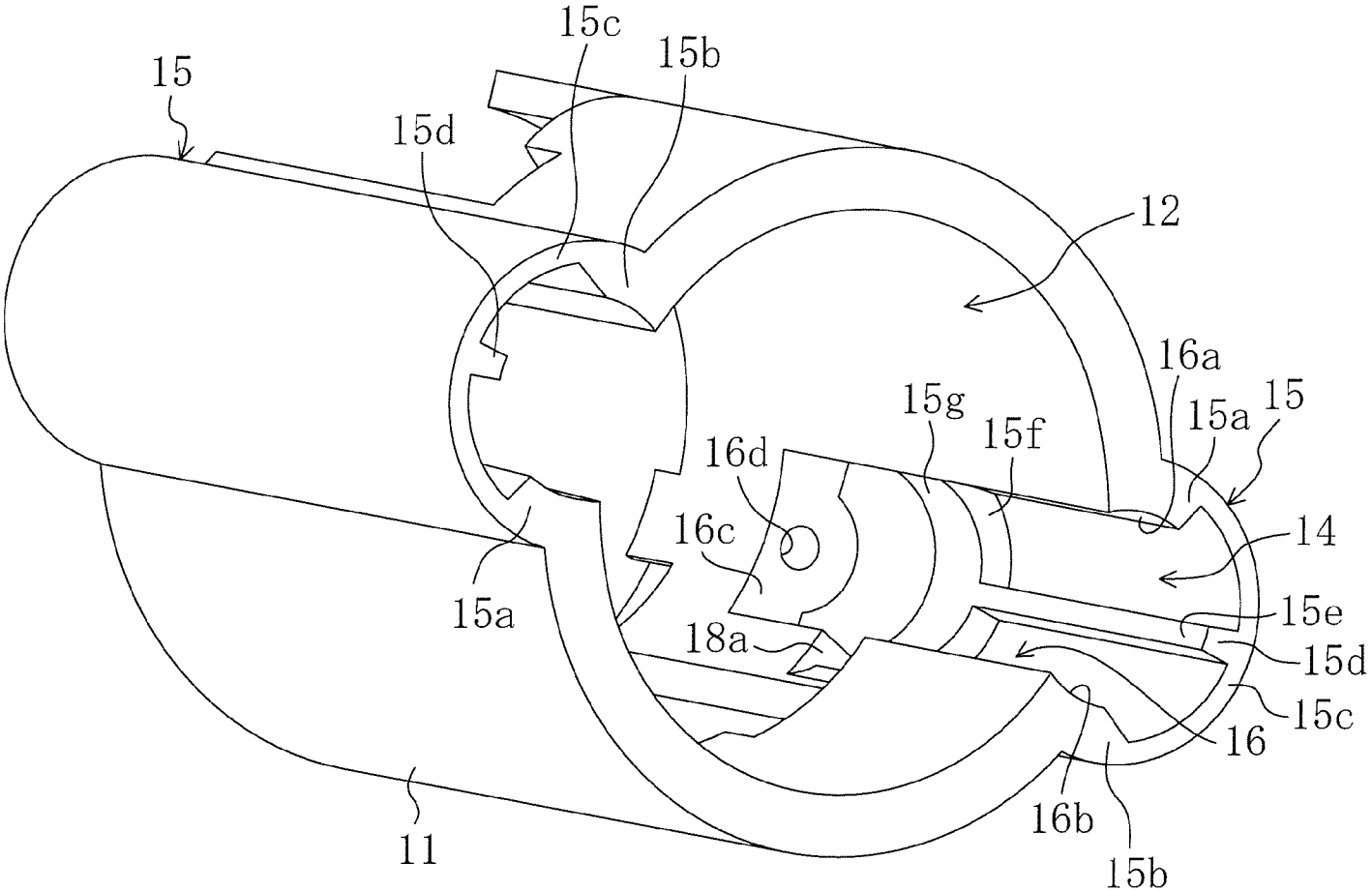
FIG. 7 is a perspective view of a part of a cylindrical wall of a casing.
Figure 8:
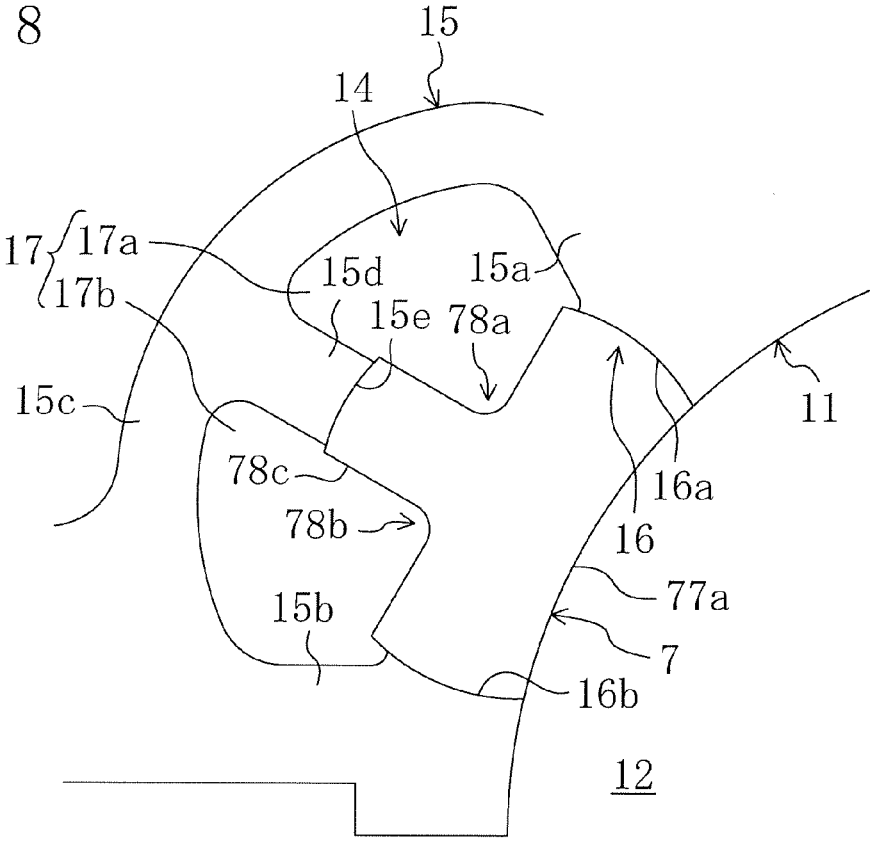
FIG. 8 is a cross-sectional view taken from line VIII-VIII in FIG. 2.

This slide valve containing-chamber (14) is space extending in the axial direction of the screw rotor (40), and is partitionally formed by a fan-shaped peripheral wall (15) formed outside the cylindrical wall (11) and by the cylindrical wall (11) as shown in FIGS. 7 and 8. Meanwhile, a part of the casing (10) other than the cylinder wall (11) and the fan-shaped peripheral wall (15) is not shown in FIG. 7. This fan-shaped peripheral wall (15) has two side walls (15*a*, 15*b*) extending from the cylindrical wall (11) outward in a substantially radial direction and an arc wall (15*c*) connecting distal ends of these two side walls (15*a*, 15*b*) in a shape of an arc, and has a substantially fan-shaped cross-section. In the arc wall (15*c*), an axial direction partition wall (15*d*) projecting inward in the radial direction in a center of a circumferential direction formed to extend in the axial direction. Furthermore, in the arc wall (15*c*), a circumferential direction partition wall (15*f*) projects inward in the radial direction at a position corresponding to the valve body (71) in the case of containing the slide valve (7) in the slide valve containing-chamber (14), and is formed to extend in the circumferential direction. This circumferential direction partition wall (15*f*) extends from one of the side walls (15*a*) up to the other side wall (15*b*) in the circumferential direction. Additionally, a projecting end surface (15*g*) of the circumferential direction partition wall (15*f*) has a shape of an inner peripheral surface of a circular cylinder matched with an outer peripheral surface of a column of the valve body (71), and is in slidable contact with the outer peripheral surface of the column of the valve body (71) in the case of containing the slide valve (7). The axial direction partition wall (15*d*) extends up to this circumferential direction partition wall (15*f*).

In the cylindrical wall (11), a slit-shaped opening (16) is also formed to extend from an end surface at the high-pressure space (S2) side to the low-pressure space (S1) side in the axial direction. This opening (16) penetrates the cylindrical wall (11) in the radial direction of the cylindrical wall (11), and enables the slide valve containing-chamber (14) to communicate with the screw rotor containing-chamber (12). Among opening end surfaces of the cylindrical wall (11) forming this opening (16), two opening end surfaces (16*a*, 16*b*) facing each other in the circumferential direction form an inner peripheral surface of a virtual circular cylinder extending in the axial direction in the slide valve containing-chamber (14) together with a projecting end surface (15*e*) of the axial direction partition wall (15*d*). This virtual circular cylinder is a circular cylinder matched with (in other words, fitted to) the slide valve (7).

Additionally, among the opening end surfaces of the cylindrical wall (11), an opening end surface (16*c*) at the axial directional low-pressure space (S1) side is formed into a plane orthogonal to the axial direction, and has a guide hole (16*d*) bored in the axial direction, the guide rod (79) of the slide valve (7) being fitted to the guide hole (16*d*).

From the high-pressure space (S2) side into the slide valve containing-chamber (14) with the valve body (71) in the lead, the slide valve (7) is inserted into a virtual circular cylinder formed by the opening end surfaces (16*a*, 16*b*) of the cylindrical wall (11) and the projecting end surface (15*e*) of the axial direction partition wall (15*d*) of the arc wall (15*c*). At this time, the valve body (71) has its columnar outer peripheral surface in slidable contact with the opening end surfaces (16*a*, 16*b*) of the cylindrical wall (11) and the projecting end surface (15*e*) of the axial direction partition wall (15*d*) as shown in FIG. 8. Additionally, in the port portion (72) and the guide portion (77), a columnar outer peripheral surface part between the first cutout portion (78*a*); and the first and second recessed portions (74, 75) and the recessed curve surface (77*a*) is in slidable contact with the opening end surfaces (16*a*). A columnar outer peripheral surface part between the second cutout portion (78*b*); and the first and second recessed portions (74, 75) and the recessed curve surface (77*a*) is in slidable contact with the opening end surfaces (16*b*). The projecting end surface of the rear surface partition wall (78*c*) is in slidable contact with the projecting end surface (15*e*) of the axial direction partition wall (15*d*).

In this way, in a state of containing the slide valve (7) in the slide valve containing-chamber (14), a discharge passage (17) is partitionally formed by the arc wall (15*c*), the side walls (15*a*, 15*b*), the circumferential direction partition wall (150, and the slide valve (7) at the rear surface side of the slide valve (7). Furthermore, this discharge passage (17) is divided into a first discharge passage (17*a*) and a second discharge passage (17*b*) by enabling the axial direction partition wall (15*d*) of the fan-shaped peripheral wall (15) to be in slidable contact with the rear surface partition wall (78*c*) of the slide valve (7), the first and second cutout portions (78*a*, 78*b*) of the slide valve (7) residing in the first and second discharge passages (17*a*, 17*b*), respectively. These first and second discharge passages (17*a*, 17*b*) are open in the high-pressure space (S2).

Figure 9:
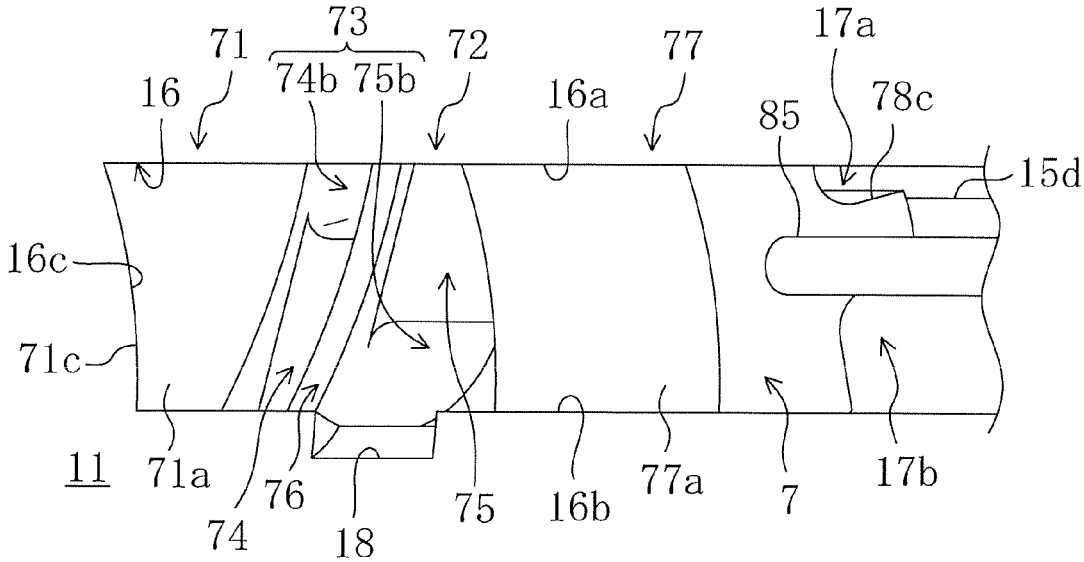
FIG. 9 is a perspective view of the slide valve contained in a slide valve containing-chamber.

On the other hand, at the screw rotor containing-chamber (12) side, as shown in FIG. 9, the recessed curve surface (71*a*) of the slide valve (7) is exposed from the opening (16) into the screw rotor containing-chamber (12), and forms an inner peripheral surface of one circular cylinder together with the inner peripheral surface of the cylindrical wall (11). At this time, the first and second recessed portions (74, 75) of the slide valve (7) are also exposed to the screw rotor containing-chamber (12) while the first and second ports (74*b*, 75*b*) are open in the screw rotor containing-chamber (12). As a result, the screw rotor containing-chamber (12) communicates with the first and second discharge passages (17*a*, 17*b*) through the first and second ports (74*b*, 75*b*).

A fixed port (18) for ejecting the gas refrigerant from the compression chamber (23) as much as possible is also formed in the opening (16) of the cylindrical wall (11). Operations of the fixed port (18) will be described in detail below. Specifically, in an edge of the opening end surfaces (16*b*) of the cylindrical wall (11) at the screw rotor containing-chamber (12) side, the fixed port (18) is formed in a part corresponding to the second recessed portion (75) of the slide valve (7) as shown in FIG. 7. The fixed port (18) is formed in the opening end surfaces (16*b*) of the cylindrical wall (11), and extends up to the second discharge passage (17*b*). Therefore, the fixed port (18) enables the screw rotor containing-chamber (12) to always communicate with the second discharge passage (17*b*) regardless of a position of the slide valve (7).

The recessed curve surface (77*a*) of the guide portion (77) is in slidable contact with an outer peripheral surface of the bearing holder (60) in the case of containing the slide valve (7) in the slide valve containing-chamber (14). In this way, by enabling the recessed curve surface (77*a*) of the guide portion (77) to be in slidable contact with the outer peripheral surface of the bearing holder (60), the slide valve (7) can be slid in the axial direction while limited in rotating on its axis, in other words, while maintaining its attitude on its axis. As a result, the valve body (71) or the port portion (72) can be prevented from rotating on its axis by a gas pressure or the like to interfere with a top land of the screw rotor (40).

Now, among opening end surfaces of the cylindrical wall (11), the opening end surface (16*c*) at the axial directional low-pressure space (S1) side is configured so as to be in close contact with the distal end surface (71*c*) of the valve body (71) in the case of containing the slide valve (7) in the slide valve containing-chamber (14). By enabling the distal end surface (71*c*) of the slide valve (7) to be in close contact with the opening end surface (16*c*) of the cylindrical wall (11), the opening (16) of the cylindrical wall (11) is put into a state completely closed by the slide valve (7).

At this time, the guide rod (79) of the slide valve (7) is slidably inserted into the guide hole (16*d*) of the opening end surface (16*c*). The slide valve (7) is slid in the slide valve containing-chamber (14) in the axial direction while guided by the guide hole (16*d*) and the guide rod (79).

Figure 10:
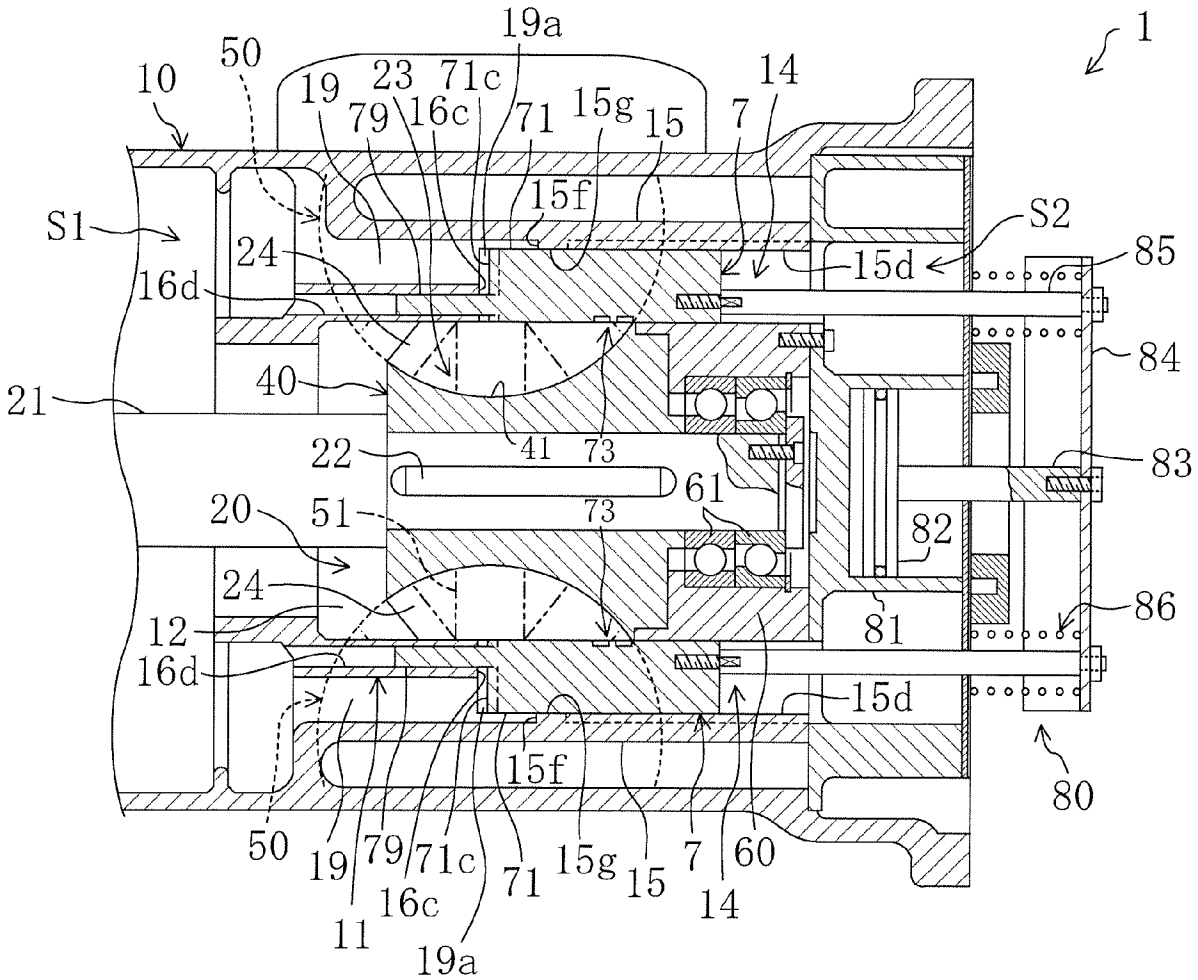
FIG. 10 is a longitudinal cross-sectional view of the single screw compressor in a state of a bypass port being open, corresponding to FIG. 2.
Figure 11:
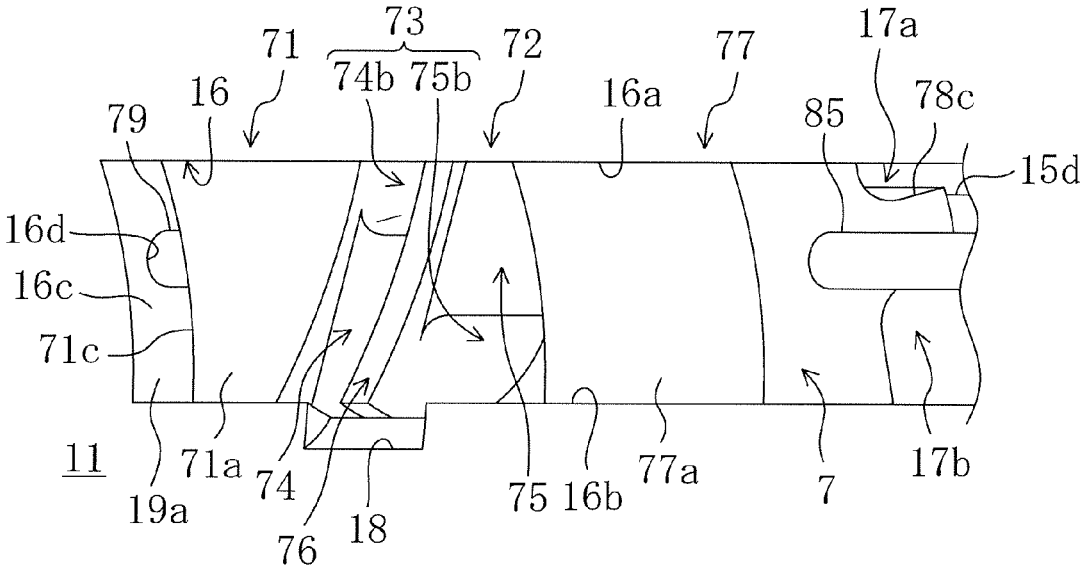
FIG. 11 is a perspective view of the slide valve contained in the slide valve containing-chamber in a state of the bypass port being open, corresponding to FIG. 9.

Outside the cylindrical wall (11), a bypass passage (19) communicating with the opening (16) is also formed (see FIG. 2). The bypass passage (19) is open in an end portion at the low-pressure space (S1) side of the opening (16). This bypass passage (19) is isolated from the first and second discharge passages (17*a*, 17*b*) by the circumferential direction partition wall (15*f*) in slidable contact with the outer peripheral surface of the column of the slide valve (7). Accordingly, as shown in FIGS. 10 and 11, by sliding the slide valve (7) in the axial direction to form a gap between the distal end surface (71*c*) of the slide valve (7) and the opening end surface (16*c*) of the cylindrical wall (11), the bypass port (19*a*) communicating with the bypass passage (19) is formed at an end portion at the low-pressure space (S1) side of the opening (16). The bypass passage (19) communicates with the low-pressure space (S1) to function as a passage for returning the refrigerant from the compression chamber (23) to the low-pressure space (S1). The slide valve (7) is moved in the axial direction to change an open degree of the bypass port (19*a*), thereby changing a capacity of the compression mechanism (20).

The screw compressor (1) is provided with a slide valve drive mechanism (80) for slidably driving the slide valve (7). This slide valve drive mechanism (80) includes a cylinder (81) fixed to the bearing holder (60), a piston (82) loaded in the cylinder (81), an arm (84) coupled with a piston rod (83) of the piston (82), coupling rods (85, 85) coupling the arm (84) with the slide valve (7), and a spring (86) biasing the arm (84) in a direction (a right direction in FIG. 2) away from the compression mechanism (20).

In the slide valve drive mechanism (80) in FIG. 2, internal pressure in left space (space at the screw rotor (40) side of the piston (82)) of the piston (82) is higher than internal pressure in right space (space at the arm (84) side of the piston (82)) of the piston (82). Furthermore, the slide valve drive mechanism (80) is configured so as to adjust the internal pressure in the right space (in other words, a gas pressure in the right space) of the piston (82) to thereby adjust a position of the slide valve (7).

During operating the screw compressor (1), in the slide valve (7), suction pressure and discharge pressure in the compression mechanism (20) act on one of its end surfaces in the axial direction and on the other, respectively. Thereby, during operating the screw compressor (1), force in a direction of pushing the slide valve (7) to the low-pressure space (S1) side always acts on the slide valve (7). Therefore, when changing internal pressure in left space and right space of the piston (82) in the slide valve drive mechanism (80), magnitude of force returning the slide valve (7) to the high-pressure space (S2) side changes, which results in a change in a position of the slide valve (7).

—Operational Action—

Operational action of the single screw compressor (1) will be described.

In the single screw compressor (1), when starting the electric motor, the screw rotor (40) rotates in accordance with rotation of the driving shaft (21). The gate rotor (50) also rotates in accordance with this rotation of the screw rotor (40), and the compression mechanism (20) repeats a suction stroke, a compression stroke, and a discharge stroke. This description will be given by focusing attention on the helical groove (41), in other words, the compression chamber (23) with hatching in FIG. 12.

In FIG. 12(A), the compression chamber (23) with hatching communicates with the low-pressure space (S1). The helical groove (41) having this compression chamber (23) formed meshes with the gate (51) of the gate rotor (50) residing in the lower side of this drawing. When the screw rotor (40) rotates, the gate (51) is relatively moved toward the terminating end of the helical groove (41), and inner volume of the compression chamber (23) expands with this movement. As a result, the low-pressure gas refrigerant in the low-pressure space (S1) is sucked through the suction port (24) to the compression chamber (23).

After the screw rotor (40) further rotates, the state changes to FIG. 12(B). In this drawing, the compression chamber (23) with hatching is in a closed state. Accordingly, the helical groove (41) having this compression chamber (23) formed meshes with the gate (51) of the gate rotor (50) residing in the upper side of this drawing, and is partitioned away from the low-pressure space (S1) by the gate (51). Furthermore, when the gate (51) is moved toward the terminating end of the helical groove (41) in accordance with the rotation of the screw rotor (40), the inner volume of the compression chamber (23) reduces gradually. As a result, a gas refrigerant in the compression chamber (23) is compressed.

Meanwhile, after the gate (51) reaches a position in a state of closing the compression chamber (23) in the helical groove (41), the gate (51) does not need to physically graze the side wall surfaces (42, 43) and the bottom wall surface (44) of the helical groove (41), and a minute gap may be formed between both of them. In other words, even if forming a minute gap between the gate (51) and the side wall surfaces (42, 43) and the bottom wall surface (44) of the helical groove (41), airtightness of the compression chamber (23) can be maintained in the case of this gap capable of being sealed with an oil film composed of lubricant, and an amount of the gas refrigerant leaked from the compression chamber (23) can be reduced at a minimal level.

After the screw rotor (40) further rotates, the state changes to FIG. 12(C). In this drawing, the compression chamber (23) with hatching, in other words, the helical groove (41) is open in the first recessed portion (74) as shown in FIG. 1(A), the compressed refrigerant gas flows out through the first port (74*b*) to the first discharge passage (17*a*). The refrigerant gas flowing out to the first discharge passage (17*a*) flows out through the first discharge passage (17*a*) to the high-pressure space (S2). Furthermore, when the gate (51) is moved toward the terminating end of the helical groove (41) in accordance with the rotation of the screw rotor (40), the compressed refrigerant gas is pushed out of the helical groove (41) while an opening area of the helical groove (41) to the first recessed portion (74) increases.

Figure 1:
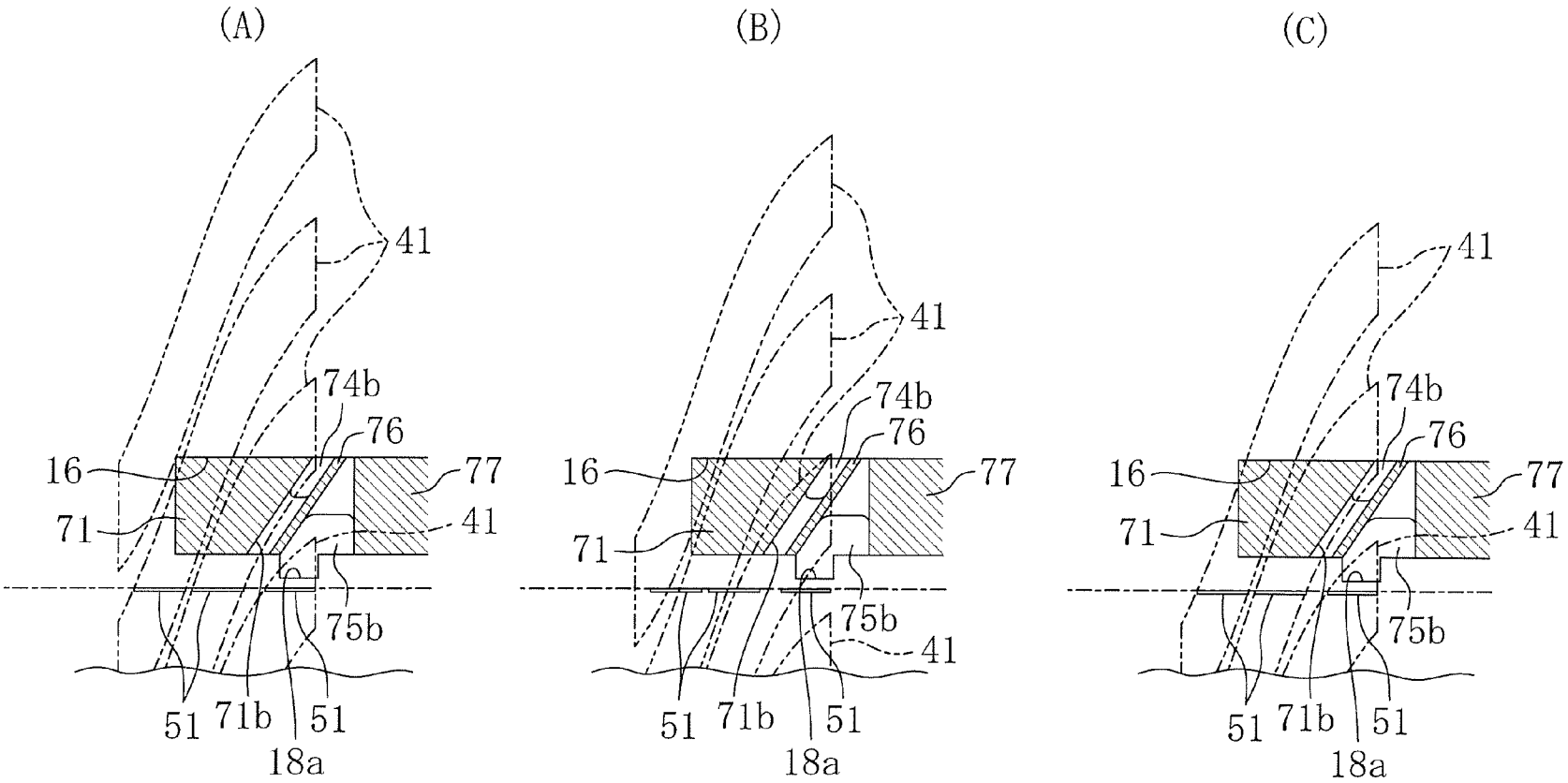
FIG. 1 is a schematic explanatory diagram of a screw compressor in accordance with an embodiment of the present invention. (A) shows a state right after open, (B) shows a state of being open in both first and second ports, (C) shows a state of being uncoupled from a discharge port.

At this time, the helical groove (41) changes in accordance with the rotation of the screw rotor (40) in the order of a state of being open only in the first recessed portion (74) (in other words, a state of communicating only with the first discharge passage (17*a*)), a state of being open in the first and second recessed portions (74, 75) (in other words, a state of communicating with the first and second discharge passages (17*a*, 17*b*)) shown in FIG. 1(B), and a state of being open only in the second recessed portion (75) (in other words, a state of communicating with the second discharge passage (17*b*)) shown in FIG. 1(C). After that, the helical groove (41) is not open even in the second recessed portion (75).

Meanwhile, right before the helical groove (41) is uncoupled from the discharge port (73), a corner at a back side (a near side) of the rotation direction of the screw rotor (40) at the terminating end of the helical groove (41) is open in the fixed port (18). In other words, by providing the fixed port (18), the configuration enables the helical groove (41) to postpone as late as possible completely not being open to discharge the gas refrigerant from the helical groove (41) as much as possible.

Now, as shown in FIG. 1(A), right after the helical groove (41) is open in the first recessed portion (74), in other words, right after it is open in the first port (74*b*), a helical groove (41) adjacent to a front side (an advancing side) of the rotation direction of the screw rotor (40) is not yet uncoupled from the second port (75*b*), but is open in the second port (75*b*). This helical groove (41) having been open more early (hereinafter, may also be referred to as a former helical groove) has the refrigerant gas almost completely discharged, and has pressure decreased in comparison with pressure right after it is open in the discharge port (73). In contrast, a helical groove (41) right after open (hereinafter, may also be referred to as a latter helical groove) is kept in a high-pressure state in which the refrigerant gas is maximally compressed.

In this embodiment, the discharge port (73) is divided into the first port (74*b*) and the second port (75*b*) by the partition wall (76). Since the distal end surface of this partition wall (76) forms an inner peripheral surface of a circular cylinder in slidable contact with the top land of the screw rotor (40) together with the inner peripheral surface of the cylindrical wall (11), the first port (74*b*) and the second port (75*b*) are independently open in the screw rotor containing-chamber (12). Furthermore, in a state in which the two adjacent helical grooves (41, 41) are simultaneously open in the discharge port (73), this partition wall (76) is provided at a position at which the latter helical groove (41) is open only in the first port (74*b*) while the former helical groove (41) is open only in the second port (75*b*). Therefore, the former helical groove (41) is open only in the second port (75*b*), and not open in the first port (74*b*). On the other hand, the latter helical groove (41) is open only in the first port (74*b*), and not open in the second port (74*b*). Thereby, the gas refrigerant discharged from the latter helical groove (41) to the first port (74*b*) flows out through the first discharge passage (17*a*) to the high-pressure space (S2). On the other hand, the gas refrigerant discharged from the former helical groove (41) to the second port (75*b*) flows out through the second discharge passage (17*b*) to the high-pressure space (S2).

Therefore, according to this embodiment, since the discharge port (73) is divided into the first port (74*b*) and the second port (75*b*) by the partition wall (76), high pressure in the latter helical groove (41) can be prevented from propagating to the former helical groove (41) and from increasing discharging work of the screw compressor (1).

Additionally, the discharge passage (17) communicating with the discharge port (73) is divided into the first discharge passage (17*a*) communicating with the first port (74*b*) and the second discharge passage (17*b*) communicating with the second port (75*b*). Thereby, a refrigerant discharged to the first port (74*b*) can be enabled to postpone joining with a refrigerant discharged to the second port (75*b*) to further reduce propagation of high pressure in the latter helical groove (41) to the former helical groove (41).

Furthermore, timing at which the helical groove (41) is open in the discharge port (73) is different depending on a position of the slide valve (7). However, by providing the first port (74*b*), the second port (75*b*), and the partition wall (76) isolating the first port (74*b*) from the second port (75*b*) in the slide valve (7), positions of the first port (74*b*), the second port (75*b*), and the partition wall (76) are also changed in response to the position of the slide valve (7) (see FIG. 10). Thereby, the former helical groove (41) and the latter helical groove (41) can be surely prevented from being open in the same discharge port (73) simultaneously.

Figure 12:
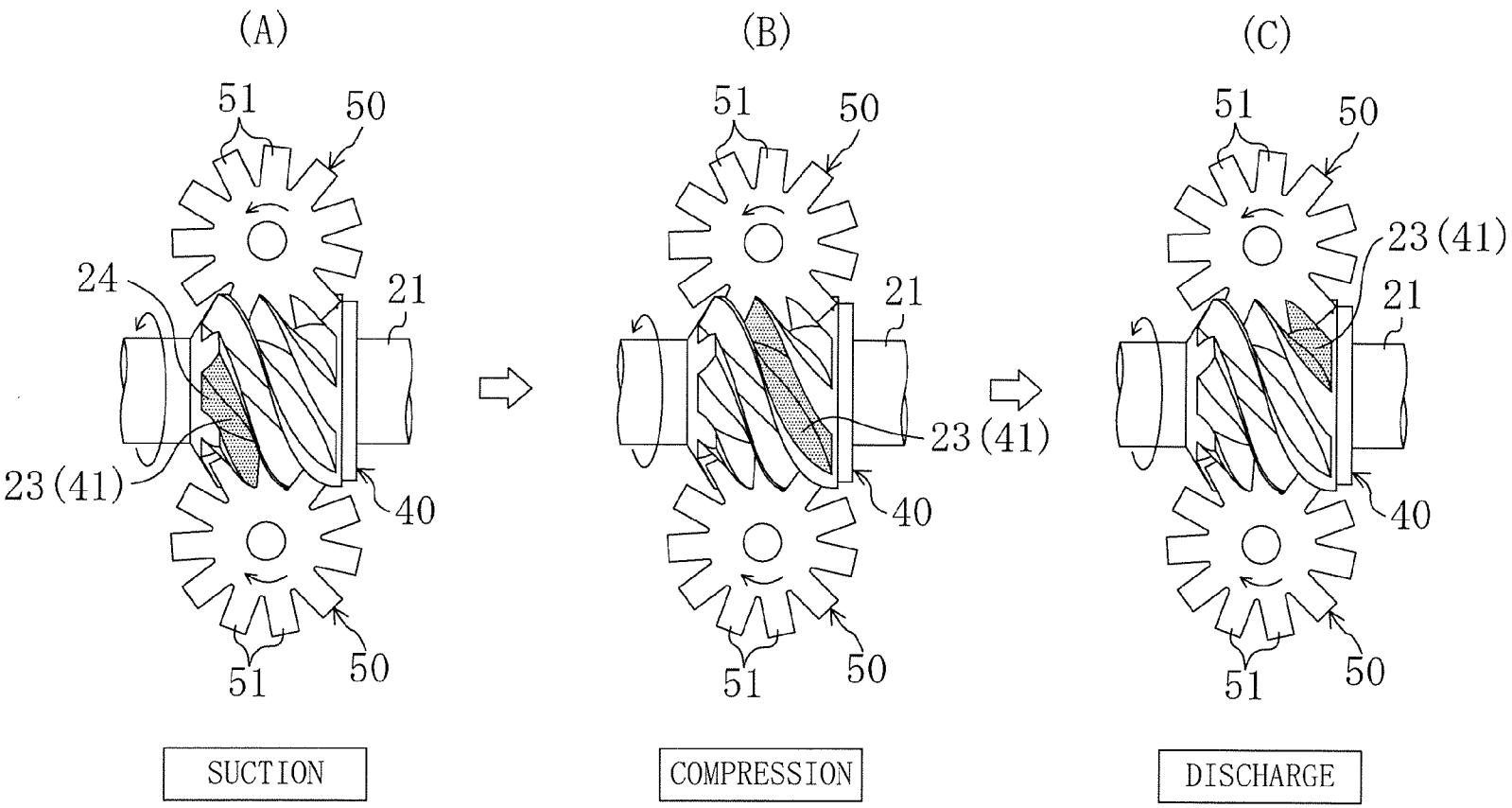
FIG. 12 is a plane view showing action of a compression mechanism in accordance with the embodiment. (A) shows a suction stroke, (B) shows a compression stroke, and (C) shows a discharge stroke.

Meanwhile, the above has described the case of a high-load operation in which the slide valve (7) completely closes the bypass port (19*a*) (in other words, the distal end surface (71*c*) of the valve body (71) is in close contact with the opening end surface (16*c*) of the opening (16)). However, the slide valve (7) can be moved to the high-pressure space (S2) in the axial direction to thereby bypass a part of the refrigerant to the low-pressure space (S1). By moving the slide valve (7) in the axial direction in this way, the first and second ports (74*b*, 75*b*) are parallelly moved in the axial direction as shown in FIG. 12. As a result, timing is simply changed which the helical groove (41) is open in the discharge port (73), or specifically the first port (74*b*), at. On the other hand, even when the slide valve (7) is moved, timing is not changed which the helical groove (41) is uncoupled from the discharge port (73) at. Accordingly, the helical groove (41) is finally open in the fixed port (18) to be uncoupled therefrom. At this time, an end portion at a front side of the rotation direction of the screw rotor (40) of the partition wall (76) may reside in the fixed port (18), and the first port (74*b*) may communicate with the second port (75*b*) through the fixed port (18). However, in such a case, timing is postponed which the helical groove (41) is open in the discharge port (73) at. Thereby, when the latter helical groove (41) is open in the first port (74*b*), the former helical groove (41) further approaches to a state of being uncoupled from the discharge port (73) to enable an opening area of the former helical groove (41) to the second port (75*b*) to be smaller in comparison with that in the case of a high load. Additionally, an opening area of the fixed port (18) to the first recessed portion (74) and the second recessed portion (75) is exceedingly small. Therefore, the first port (74*b*) communicates with the second port (75*b*) through the fixed port (18), which has a small effect. Even in such a case, by providing the partition wall (76) to divide the first port (74*b*) and the second port (75*b*), pressure can be inhibited from propagating from the latter helical groove (41) to the former helical groove (41). Meanwhile, in the case of needing to inhibit propagation of pressure even through the fixed port (18), shapes of the partition wall (76) and a cutout portion (78*a*) may be set so as to enable the partition wall (76) not to reside at (reach) the fixed port (18) even when the slide valve (7) is moved the closest to the high-pressure space (S2).

An Embodiment 2 of the Present Invention

Next, a slide valve in accordance with an embodiment 2 of the present invention will be described.

A slide valve (207) in accordance with the embodiment 2 has a configuration of a port portion different from that of the embodiment 1. The configuration of the other parts of the screw compressor is similar to that of the embodiment 1. Thus, the configuration similar to that of the embodiment 1 is denoted with similar reference signs, and descriptions of the similar configuration will be omitted. Different parts of the configuration will be mainly described.

Figure 13:
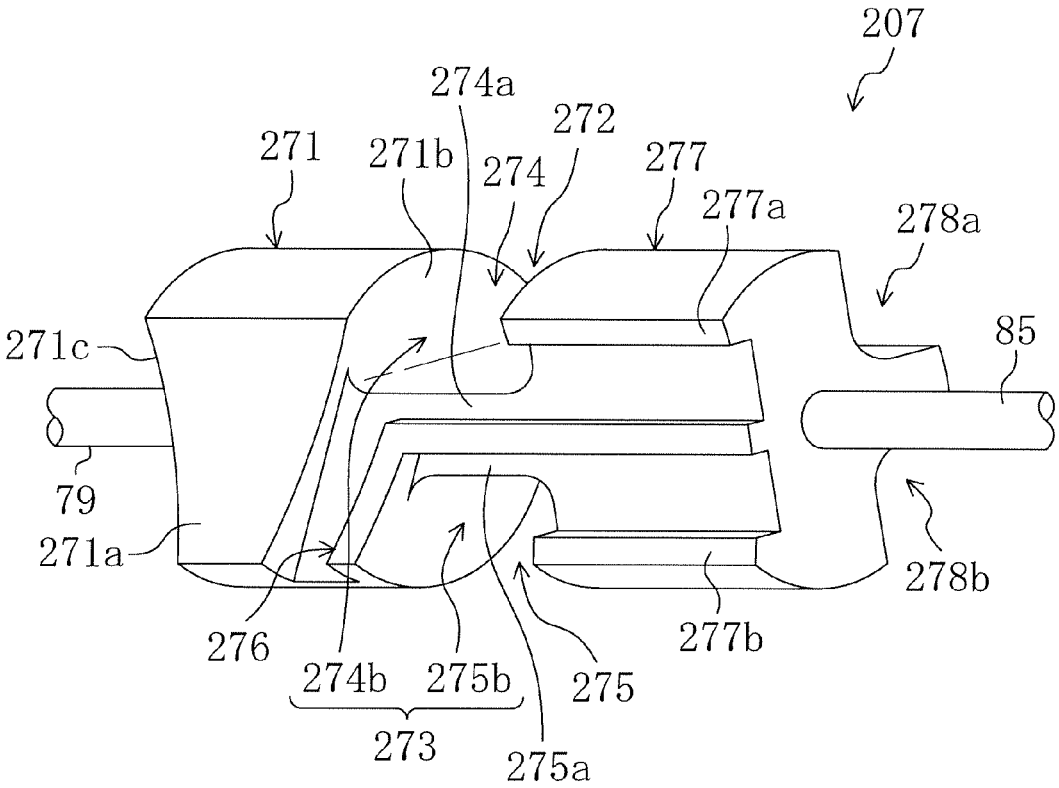
FIG. 13 is a perspective view of a slide valve in accordance with an embodiment 2.

As shown in FIG. 13, the slide valve (207) in accordance with the embodiment 2 has a partition wall (276) formed into a substantial L-shape at a port portion (272).

Circumstantially, the partition wall (276) extends from the front side (the forwarding side, or a lower side in FIG. 12) toward the rear side (the reverse side, or an upper side in FIG. 12) of the rotation direction of the screw rotor (40) substantially parallelly to an inclined surface (271*b*) of a valve body (271), and then is bent in the axial direction of the slide valve (207) to extend in this axial direction.

Additionally, in the port portion (272), a first recessed portion (274) and a second recessed portion (275) are formed which are more depressed inward in the radial direction than a recessed curve surface (271*a*) of the valve body (271).

The first recessed portion (274) is formed from a region between the inclined surface (271*b*) of the valve body (271) and the partition wall (276) to a region at the back side of the rotation direction of the screw rotor (40) with respect to the partition wall (276). In a depressed surface (274*a*) of this first recessed portion (274), a first port (274*b*) is formed similarly to the embodiment 1. This first port (274*b*) is formed into a groove by cutting a columnar side surface part between the first recessed portion (274) and a first cutout portion (278*a*) at a rear surface side in a radial direction, and enables the first recessed portion (274) to communicate with the first cutout portion (278*a*).

On the other hand, the second recessed portion (275) is formed at a region at the front side of the rotation direction of the screw rotor (40) with respect to the partition wall (276). In a depressed surface (275*a*) of this second recessed portion (275), a second port (275*b*) is formed similarly to the embodiment 1. This second port (275*b*) is formed into a groove by cutting a columnar side surface part between the second recessed portion (275) and a second cutout portion (278*b*) at a rear surface side in the radial direction, and enables the second recessed portion (275) to communicate with the second cutout portion (278*b*).

In this way, the first recessed portion (274) is isolated from the second recessed portion (275) by the partition wall (276). In other words, in a discharge port (273), the first port (274*b*) is isolated from the second port (275*b*) by the partition wall (276).

Additionally, the partition wall (276), the depressed surface (274*a*) of the first recessed portion (274), and the depressed surface (275*a*) of the second recessed portion (275) extend across a guide portion (277).

Circumstantially, in the guide portion (277), a first guide portion (277*a*) is formed which extends in the axial direction of the screw rotor (40) in an edge of the depressed surface (274*a*) of the first recessed portion (274) at the back side of the rotation direction of the screw rotor (40) and projects from the depressed surface (274*a*), and a second guide portion (277*b*) is formed which extends in the axial direction of the screw rotor (40) in an edge of the depressed surface (275*a*) of the second recessed portion (275) at the front side of the rotation direction of the screw rotor (40) and projects from the depressed surface (275*a*).

Furthermore, projecting end surfaces of this first guide portion (277*a*) and this second guide portion (277*b*) and a projecting end surface of the partition wall (276) are curved similarly to the recessed curve surface (271*a*) of the valve body (271), and form an inner peripheral surface of the same circular cylinder together with the recessed curve surface (271*a*). In other words, a part of the partition wall (276) residing at the port portion (272) is in slidable contact with an outer peripheral surface of the screw rotor (40) together with the recessed curve surface (271*a*) of the valve body (271). Additionally, a part of the partition wall (276) residing at the guide portion (277), the first guide portion (277*a*), and the second guide portion (277*b*) are configured so as to be in slidable contact with an outer peripheral surface of the bearing holder (60).

Similarly to the embodiment 1, the slide valve (207) configured in this way is contained in the slide valve containing-chamber (14), and configures the discharge port (73) of the compression mechanism (20).

This slide valve (207) not only enables the refrigerant gas discharged from the compression chamber (23) to flow out through the first and second ports (274*b*, 275*b*) from the first and second discharge passages (17*a*, 17*b*) to the high-pressure space (S2), but also enables a part of the refrigerant gas to flow out through a passage partitionally formed by the first guide portion (277*a*), the partition wall (276), and the bearing holder (60) and through a passage partitionally formed by the second guide portion (277*b*), the partition wall (276), and the bearing holder (60) to the high-pressure space (S2).

This slide valve (207) in accordance with the embodiment 2 can also have operations and advantageous effects similar to the embodiment 1.

Meanwhile, the above embodiments are essentially preferred examples and are not intended to limit the present invention, applicable matters, and the scope of use.

INDUSTRIAL APPLICABILITY

As described above, the present invention is useful for a screw compressor in which two adjacent helical grooves may be simultaneously open in a discharge port.

What is claimed is:

1. A screw compressor comprising:

a screw rotor having a plurality of helical grooves;

a casing containing the screw rotor;

a slide valve arranged in an opening of the casing, the slide valve defining at least part of a discharge port from which compressed gas is discharged; and a gate rotor having gates meshing with the plurality of helical grooves of the screw rotor to compress gas in compression chambers and to discharge the gas from the discharge port after being compressed in the compression chambers, the compression chambers being defined by the plurality of helical grooves, the casing, and the gates, the discharge port being divided into a first port and a second port by a first partition wall provided in the slide valve when two adjacent helical grooves of the plurality of helical grooves are open to the discharge port as a result of rotation of the screw rotor, with one of the two adjacent helical grooves being open to the first port and the other of the two adjacent helical grooves being open to the second port, and the casing and the slide valve, in combination, defining a discharge passage arranged to communicate with the discharge port, the discharge passage being formed downstream of the discharge port with respect to a fluid flow direction.

2. The screw compressor in accordance with claim 1, wherein at least one of the casing and the slide valve includes a second partition wall which at least partially divides the discharge passage into a first discharge passage communicating with the first port and a second discharge passage communicating with the second port.

* * * * *